United States Patent [19]

Burbank et al.

[11] Patent Number: 4,550,429

[45] Date of Patent: Oct. 29, 1985

[54] SHOCK ABSORBING TRANSDUCER MODULE

[75] Inventors: Raymond W. Burbank, North Lauderdale; Christopher A. Myers, Boca Raton, both of Fla.

[73] Assignee: Motorola, Inc., Schaumburg, Ill.

[21] Appl. No.: 500,722

[22] Filed: Jun. 3, 1983

[51] Int. Cl.[4] ..... H04R 1/02

[52] U.S. Cl. ..... 381/90; 179/146 R; 179/146 E; 381/91

[58] Field of Search ..... 179/146 E, 146 R, 179, 179/180; 381/90, 91, 88, 87, 78, 86; 181/150, 155

[56] References Cited

U.S. PATENT DOCUMENTS

| | | | |
|---|---|---|---|
| 1,781,605 | 11/1930 | Seibert | 179/146 E |
| 2,718,563 | 9/1955 | Nicholides | 179/179 |
| 3,237,713 | 3/1966 | Leslie | 179/179 |
| 3,306,990 | 2/1967 | Walker | 179/102 |
| 3,548,121 | 12/1970 | Gorike et al. | 179/179 |
| 3,645,356 | 2/1972 | Sotome | 179/179 |
| 3,692,264 | 9/1972 | Burkhard et al. | 179/179 |
| 3,716,671 | 2/1973 | Karr | 181/150 |
| 3,720,285 | 3/1973 | Russell et al. | 179/179 |
| 3,944,759 | 3/1976 | Penning | 179/179 |
| 3,947,646 | 3/1976 | Saito | 179/179 |
| 3,947,647 | 3/1976 | Swinehart | 179/179 |
| 3,987,258 | 10/1976 | Tsutsui | 181/155 |
| 4,038,502 | 7/1977 | Ambruoso | 179/179 |
| 4,113,999 | 9/1978 | Swinehart | 179/179 |
| 4,152,544 | 5/1979 | Sanpel et al. | 179/179 |
| 4,152,553 | 5/1979 | White | 179/179 |
| 4,225,970 | 9/1980 | Jaramillo et al. | 179/179 |
| 4,359,133 | 11/1982 | Krolak | 179/179 |
| 4,434,329 | 2/1984 | Nasu | 179/146 R |
| 4,439,643 | 3/1984 | Schweizer | 179/146 R |

FOREIGN PATENT DOCUMENTS

| | | | |
|---|---|---|---|
| 2305488 | 2/1973 | Fed. Rep. of Germany | 179/100 L |
| 56-111632 | 3/1981 | Japan | 179/179 |
| 2064265 | 6/1981 | United Kingdom | 179/179 |

*Primary Examiner*—Gene Z. Rubinson
*Assistant Examiner*—L. C. Schroeder
*Attorney, Agent, or Firm*—Joseph T. Downey; Martin J. McKinley; Edward M. Roney

[57] ABSTRACT

A modular transducer mounting arrangement includes a substantially planar support plate. An aperture having an angular bevel is provided in the support plate such that a loudspeaker may be positioned in the bevel to allow sound to exit from the loudspeaker in a manner which is substantially unobstructed acoustically. An adhesive shock absorbing pad is attached to the rear of the support plate for isolating the loudspeaker microphone and support plate from mechanical shock. This creates a free floating and reliable transducer mounting assembly which provides shock isolation and easy serviceability.

14 Claims, 4 Drawing Figures

SHOCK ABSORBING TRANSDUCER MODULE

BACKGROUND OF THE INVENTION

1. Field of the Invention

This invention relates generally to the field of mounting arrangements for electro-acoustical transducers. More particularly, this invention relates to a modularized floating transducer assembly for retaining and protecting a microphone and a loudspeaker in a portable electronic apparatus.

2. Background of the Invention

Portable two-way voice communications equipment typically requires a speaker and a microphone for converting electrical signals into acoustic signals and vice-versa. Traditionally these tranducers have been rigidly attached to the housing of the apparatus in some manner and electrically interconnected with their associated circuitry via wires amd wiring harnesses. The transducers themselves are normally mounted to the housing by traditional fasteners such as screws and brackets. Unfortunately, traditional transducer mounting arrangements present many fit and tolerance problems and occupy valuable space in modern miniature two way transceivers creating interferences with electronic components and possible electrical shorts. In addition, installation is cumbersome and time consuming as is replacement, if necessary. In fact, it has been observed that the screws utilized in traditional fastening techniques can actually deform the web-like frames of many miniature loudspeakers resulting in poor audio efficiency and high distortion.

A further disadvantage of prior art transducer mounting arrangements is that the entire electronic assembly including transducers is difficult to electrically test as a unit since the transducers themselves are physically mounted to the transceiver housing and must often be disconnected from the chassis in order to remove the transceiver electronic chassis.

Since the electro-acoustical transducers are among the most failure-prone components in a two-way transceiver, it is advantageous to isolate these components from mechanical shock and make their removal and installation as simple as possible in order to maintain high reliability and ease of service. The traditional fastener arrangements for transducer mounting used in the prior art fall far short of this need.

SUMMARY OF THE INVENTION

It is an object of the present invention to provide an improved shock absorbing transducer module.

It is another object of the present invention to provide a floating transducer arrangement which provides shock isolation to the transducers along with shock isolation to other delicate electronic components.

It is another object of the present invention to provide an easily serviceable self-contained transducer assembly for miniature electronic devices.

It is a further object of the present invention to provide a transducer assembly which overcomes the shortcomings of the prior art.

These and other objects of the invention will become apparent to those skilled in the art upon consideration of the following description of the invention.

In accordance with one embodiment of the present invention a floating, shock absorbing transducer mounting assembly includes a substantially planar transducer support plate. A loudspeaker is positioned upon the support plate in a manner that allows the sound exit port of the loudspeaker to be substantially unobstructed acoustically. A shock cushion is attached to the support plate and isolates the loudspeaker and support plate from mechanical shock while also providing shock isolation to other delicate electronic components and urging the assembly into engagement with a housing.

The features of the invention believed to be novel are set forth with particularity in the appended claims. The invention itself however, both as to organization and method of operation, together with further objects and advantages thereof, may be best understood by reference to the following description taken in conjunction with the accompanying drawings.

DESCRIPTION OF THE PREFERRED EMBODIMENT

Figure 1:
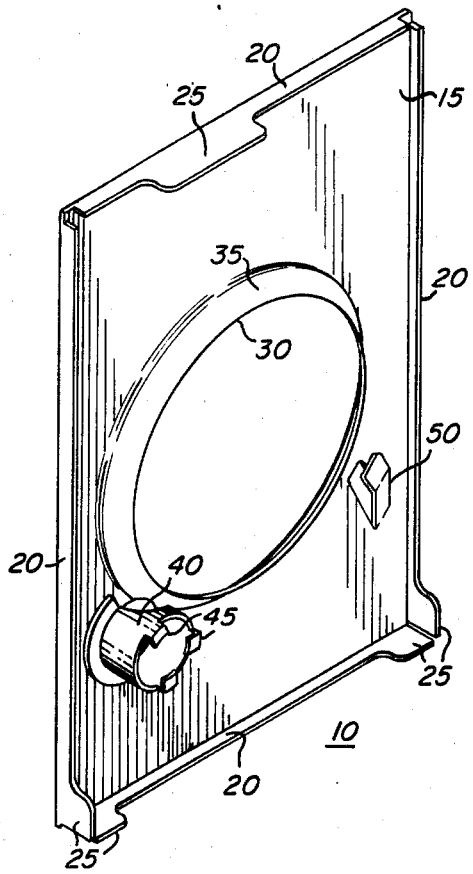
FIG. 1 is a perspective view of the mounting plate of the present invention.

Turning now to FIG. 1, a rear perspective view of support plate 10 is shown. Support plate 10 has a substantially planar body 15 which is preferably made of tin plated nickel-silver sheet metal approximately 0.015 inch thick and has a reinforcing lip 20 which is bent or drawn around the periphery of body 15. This lip 20 provides mechanical rigidity to the support plate so that body 15 may be thin without a substantial sacrifice of strength. In the preferred embodiment lip 20 is bent at an approximate 90° angle to the plane of the support plate.

Lip 20 may preferrably include one or more stops 25 to prevent the assembly from creeping away from its designated location when installed. These stops 25 may be keyed or strategically located to prevent installation of the completed assembly in the housing in an improper manner.

Body 15 includes an aperture 30 having a diameter slightly smaller than that of the loudspeaker for receiving the loudspeaker. This aperture 30 preferrably has an angular bevel 35 around its circumference extending substantially rearward for cradling a loudspeaker inserted from the front.

A cylindrical microphone retainer 40 is utilized in the preferred embodiment to retain the preferred cylindrical microphone. The microphone retainer 40 includes one or more tabs 45 to prevent the microphone from being inserted too far within cylinder 40. Microphone retainer 40 may be made of metal and spot welded, soldered or otherwise attached to body 15. Microphone retainer 40 includes an aperture in its front-most portion for aligning with a similar aperture in the body 15 to allow sound to enter the microphone substantially acoustically unobstructed. In the preferred embodiment a strain relief member 50 is punched from body 15 and bent in an appropriate manner as shown to retain and relieve strain from any wires which must interconnect with the loudspeaker and microphone.

Figure 2:
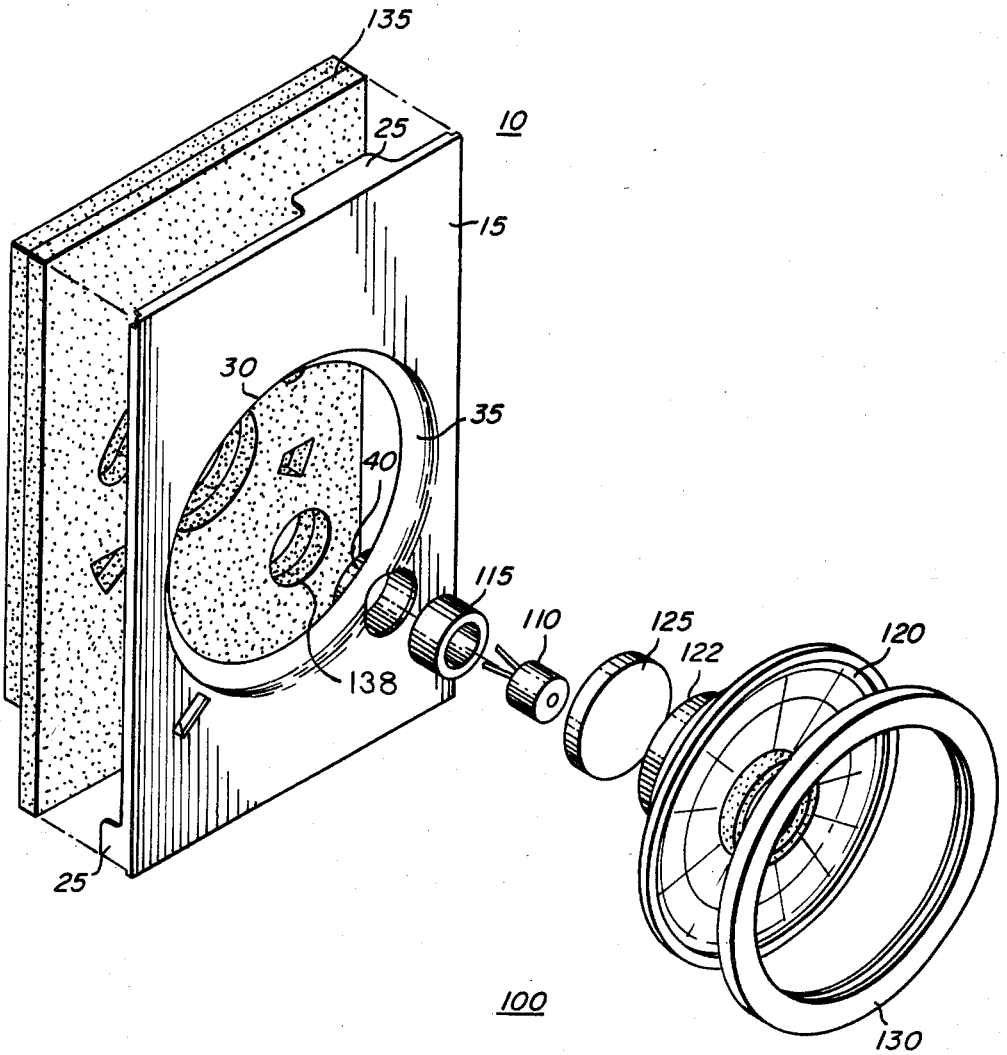
FIG. 2 is an exploded view of the shock isolating transducer mounting arrangement of the present invention.

Turning now to FIG. 2, an exploded view of the transducer module assembly 100 is shown. In the preferred embodiment, a microphone 110 which is substantially cylindrical in shape is inserted into a rubber boot 115 with an interference fit in order to captivate microphone 110. This rubber boot 115 along with microphone 110 is in turn inserted into the microphone retainer 40 until the microphone boot 115 encounters tabs 45. There is also preferrably an interference fit between cylindrical microphone retainer 40 and rubber boot 115.

While this is the preferred assembly technique for the microphone portion of this assembly, it will be clear to those skilled in the art that many other microphone mounting arrangements will equally well suffice. In fact, other mounting arrangements may be necessitated by the shape and form factor of the microphone being used. In the preferred embodiment of the present invention a miniature electret microphone such as the Primo model EM-76 manufactured by Primo Co. Ltd. is utilized but this is not to be limiting.

Assembly 100 will normally include a loudspeaker 120 having a magnet structure 122. In the preferred embodiment, a disk-like shock pad 125 which is preferrably composed of a cellular silicon rubber material is applied to the magnet by an adhesive. A thickness of approximately 1/20th of an inch for shock pad 125 has been found suitable for many applications.

In the preferred embodiment, an acoustic seal 130 may be applied to the perimeter of loudspeaker 120. A very short section of heat shrinkable tubing having a diameter slightly larger than the loudspeaker has been found suitable for this purpose. By placing the loudspeaker inside the length of tubing and applying heat to the tubing, a permanent seal to the periphery of speaker 120 may be obtained. Loudspeaker 120 is then placed within the angular bevel 35 of aperture 30 where it is cradled while retaining some freedom of movement.

At this point in the assembly, the appropriate electrical wiring may be done. A preferred technique will be discussed later. After the electrical wiring takes place a shock cushion 135 is placed over the rear of the assembly. This cushion 135 may be held in place by an adhesive such as 3M Model 950 adhesive though this is not to be limiting as many other adhesives may be acceptable. This adhesive attached to cushion 135 also serves to restrain the movement of the loudspeaker somewhat for ease of handling and assembly. It has been found convenient to utilize more than one layer of shock cushion so that varying thicknesses may be obtained by cutting away portions of one or more layers of cushion. In the preferred embodiment each layer is approximately 0.1 inch in thickness. Certain areas of the shock cushion 135 may be cut away entirely such as hole 138 to accommodate, for example, microphone 110, speaker magnet 122 or other large components.

Figure 3:
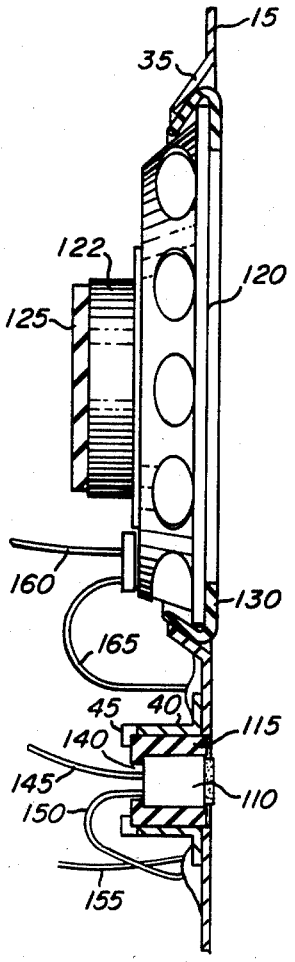
FIG. 3 is a partial cross-sectional view of the transducer mounting assembly taken along lines 3—3 of FIG. 4.

Referring now to FIG. 3, a cross-sectional detail of the partially assembled transducer module 100 is shown. The heat shrunk acoustic seal 130 is seen to conform to the shape of the frame of loudspeaker 120 and provides a seal at the interface of the angular bevel 35 of aperture 30 and the loudspeaker. This helps prevent out of phase energy radiating from the rear of loudspeaker 120 from creating destructive interferrence with sound waves exiting the front of loudspeaker 120. The relationship of the disk-like shock pad 125 to the loudspeaker magnet may also be seen more clearly from this figure.

The mounting arrangement for microphone 110 is also more clearly shown in FIG. 3. The microphone is pressed into boot 115 all the way to the rear and boot 115 is shown to be inserted inside the cylindrical microphone retainer 40 all the way to the tabs 45. This arrangement assures an accurate and repeatable mounting position for microphone 110.

Microphone boot 115 is shown to have an aperture 140 in its rear-most portion to allow for the passage of any wiring necessary to the operation of microphone 110. Such microphones will normally have two wires for electrical interconnection. A signal wire 145 may be passed through this opening along with a ground wire 150 which may be soldered directly to the nickel-silver body of support plate 10 as shown. In the preferred embodiment ground connection from the transceiver electrical chassis 210 may then be coupled to the microphone via a ground wire 155 which may also be soldered to the body of the support plate. A second signal wire 160 may be coupled to the loudspeaker to provide electrical impulses thereto. The speaker's ground connection wire 165 may also be connected to the body of support plate 10 as shown. In this manner, ground wire 155 may serve as a common ground connection for both transducers.

Figure 4:
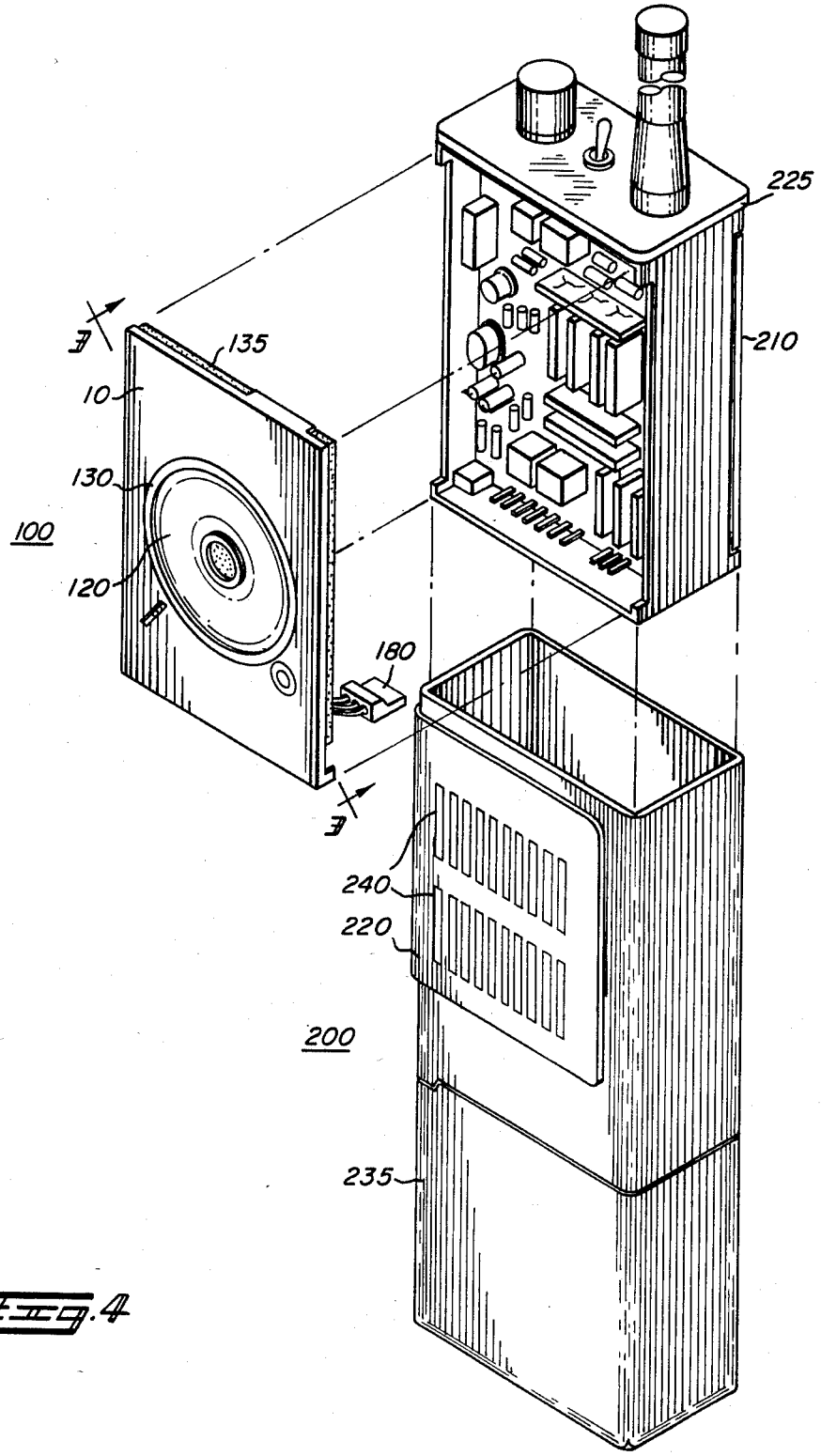
FIG. 4 is an exploded view of a transceiver assembly which utilizes the present transducer assembly.

In FIG. 4, the completed assembly 100 including shock cushion 135 is shown. In this completed assembly, the plate 10 forms a baffel, even when outside the housing, to prevent destructive interference resulting from sound waves eminating from the rear of the loudspeaker interfering with those eminating from the front. Wires 145, 155, and 160 are shown to be connected to a plug-in connector 180 to allow for modular installation of the transducer module 100. Plug-in connector 180 may be coupled electrically to a mating socket (not shown) in a transceivers electrical chassis 210 to complete electrical connection thereto. Preferrably the wires connected to plug-in connector 180 are sufficiently long to allow transducer module 100 to be moved completely out of the way of the electrical components on chassis 210 and allow for ease of testing and service.

To complete assembly 200, the floating transducer board 100 is simply laid in place inside the radio chassis with the speaker cone facing outward. The shock cushion 135 is lightly compressed against the electrical components shown on chassis 210. The chassis and transceiver module may then be slid into molded plastic housing 220 from the top. The bottom of plastic housing 220 is closed and may be water sealed. It is evident that the free floating nature of this invention within the transceiver housing reduces or eliminates many of the fit problems associated with prior art transducer assemblies.

The upper portion of the housing 220 may be water sealed by an O-ring (not shown) located at the upper portion 225 of radio chassis 210. This O-ring compresses against the inside of the housing when the radio is finally assembled. To hold the chassis in place within the housing, a pair of screws (not shown) passing through the bottom of the housing may screw into the frame of chassis 210 drawing it fully into the housing 220 and completing the water seal. A slide-on battery 235 may be attached to the bottom of housing 220 to provide electrical power to chassis 210.

Once the assembly is completed, the front portion of acoustic seal 130 is pressed firmly against the inner surface of transceiver housing 220 providing a seal against the front cover of the housing. In this manner, acoustic energy eminating from the rear of loudspeaker 120 is prevented from exiting a speaker grille 240 to produce destructive interference while sound eminating from the front of loudspeaker 120 is allowed to readily pass through speaker grille 240. Shock cushion 135 serves to dampen those sound waves eminating from the rear of loudspeaker 120 to provide proper acoustical loading of the speaker enclosure and dampen any standing waves. Shock cushion 135 further serves to dampen any resonance of loudspeaker 120 along with any resonance of support plate 10 to help provide a more desirable audio frequency response. In normal operation, sound enters the housing through a sound entry path, which may be integral with the speaker grille 240, and is directed toward the microphone. Thus, a single assembly supports and positions both transducers for the transceiver's operation.

A secondary benefit of this mounting technique is that the electrical components mounted on chassis 210 are also shock isolated by shock cushion 135 since they are in intimate contact with the compressed shock cushion in final assembly.

A further benefit of the present invention is that of electrical shielding. Since support plate 10 is preferrably made of a conductive material, the chassis 210 is effectively electrically shielded by it. One skilled in the art will readily appreciate that it is often the case that the inner surface of a transceiver housing 220 must be coated with electrically conductive paint or otherwise made to be an effective electrical shielding medium in order to assure stable transmitter operation and a predictable antenna radiation pattern. Since support plate 10 is metallic, substantially better conductivity is obtained with it than could be attained by conductive painting which is acknowledged as an expensive and labor intensive process. As a result of this design, it may be possible to eliminate or substantially reduce the amount of conductive painting necessary to obtain proper radio performance. Also since the shielding is not part of the housing, proper transceiver performance may be attained when chassis 210 is outside the housing to facilitate transceiver design and testing.

This transducer mounting arrangement also provides for reduced wiring requirements since no wiring to the actual radio housing 220 is necessary. all interconnections are made in modular form and the transceiver may be more effectively water sealed. Since no screws or washers are utilized to accomplish the present transceiver mounting arrangement, there is no danger of them vibrating loose in use and causing either speaker rattles or electrical shorts. Also there is no danger of deforming the loudspeaker's frame with such fasteners and assembly cost in labor is substantially reduced.

Thus, it is apparent that in accordance with the present invention, an apparatus that fully satisfies the objects aims and advantages is set forth above. While the invention has been described in conjunction with several specific embodiments, it is evident to those skilled in the art that many alternatives, modifications, and variations will be apparent in light of the foregoing description. Accordingly, it is intended that the present invention embrace all such alternatives, modifications, and variations as fall within the spirit and broad scope of the apended claims.

What is claimed is:

1. A modular transducer mounting assembly, comprising:

a substantially planar support plate having a rear surface;

a shock absorbing cushion, said cushion being substantially planar and attached to said rear surface of said support plate for isolating said plate from mechanical shock while urging said support plate forward when said cushion is compressed from the rear;

said support plate including an aperture and a rearward angular bevel around the perimeter of said aperture;

a loudspeaker, positioned in said aperture and cradled by said rearward angular bevel;

means for attaching a microphone having a sound entry port to said support plate, such that said sound entry port is substantially unobstructed acoustically; and a microphone connected to said attaching means.

2. The assembly of claim 1, further including interconnection means for electrically coupling to said loudspeaker and to said microphone.

3. The assembly of claim 2, wherein said interconnecting means includes a plurality of wires and further including a strain relief attached to said support plate for relieving strain on said wires.

4. The assembly of claim 3, wherein said interconnecting means includes an electrical connector attached to said wires for electrically connecting to said loudspeaker and to said microphone.

5. The assembly of claim 4, wherein said support plate is electrically conductive and wherein said microphone and said loudspeaker share a common ground connection and said ground connection is electrically coupled to said support plate.

6. The assembly of claim 1, wherein said attaching means includes a rubber boot for holding said microphone in a friction fit.

7. The assembly of claim 1, further including an acoustic sealing means for providing a seal between said loudspeaker and said support plate.

8. The assembly of claim 1, further comprising:

housing means having a loudspeaker grille for containing said support plate and said loudpeaker.

9. The assembly of claim 8, wherein said housing further includes a sound entry path such that sound entering said sound entry path is coupled to said microphone.

10. A modular transducer mounting assembly, comprising:

a substantially planar support plate having a rear surface;

a shock absorbing cushion, said cushion being substantially planar and attached to said rear surface of said support plate for isolating said plate from mechanical shock while urging said support plate forward when said cushion is compressed from the rear;

said shock absorbing cushion including first and second layers of low density open celled foam, said second layer of low density open celled foam being attached to said first layer of low density open celled foam, and wherein a portion of said second layer of low density open celled foam is cut away to expose a portion of said first layer of low density open celled foam; and loudspeaker positioning means adapted for positioning a loudspeaker on said support plate, said loudspeaker positioning means including an aperture in said support plate.

11. A modular transducer mounting assembly, comprising:

a substantially planar support plate having a rear surface, said support plate includes a plurality of stops, wherein said stops are keyed to prevent improper installation of said support plate;

a shock absorbing cushion, said cushion being substantially planar and attached to said rear surface of said support plate for isolating said plate from mechanical shock while urging said support plate forward when said cushion is compressed from the rear; and loudspeaker positioning means adapted for positioning a loudspeaker on said support plate, said loudspeaker positioning means including an aperture in said support plate.

12. The assembly of claim 11, wherein said support plate is made of an electrically conductive material.

13. The assembly of claim 11, further including a reinforcing lip substantially around the periphery of said support plate.

14. A modular loudspeaker mounting assembly, comprising:

a substantially planar electrically conductive support plate having a rear surface, an aperture, and a perimeter;

a rearward angular bevel around the periphery of said aperture;

a substantially planar layer of low density open celled foam attached to the rear surface of said support plate;

a loudspeaker, having an outer circumference, resting within said aperture;

an acoustic seal sealing said loudspeaker's outer circumference to said angular bevel;

a microphone;

microphone mounting means attached to said support plate and holding said microphone in place on said support plate, said microphone mounting means including a rubber boot holding said microphone in a friction fit;

a reinforcing lip substantially surrounding the perimeter of said support plate;

a plurality of wires appropriately coupled to said microphone and said loudspeaker; and a strain relief attached to said support plate for relieving stress from said wires.

* * * * *